US012359368B2

(12) United States Patent
Toyabe et al.

(10) Patent No.: US 12,359,368 B2
(45) Date of Patent: Jul. 15, 2025

(54) WATER-REPELLENT WOVEN OR KNITTED ARTICLE, PRODUCTION METHOD FOR SAME, AND GARMENT

(71) Applicant: Toray Industries, Inc., Tokyo (JP)

(72) Inventors: Keigo Toyabe, Otsu (JP); Kazuya Fujita, Osaka (JP)

(73) Assignee: Toray Industries, Inc., Tokyo (JP)

( * ) Notice: Subject to any disclaimer, the term of this patent is extended or adjusted under 35 U.S.C. 154(b) by 1020 days.

(21) Appl. No.: 17/421,493

(22) PCT Filed: Jan. 22, 2020

(86) PCT No.: PCT/JP2020/002063
§ 371 (c)(1),
(2) Date: Jul. 8, 2021

(87) PCT Pub. No.: WO2020/158530
PCT Pub. Date: Aug. 6, 2020

(65) Prior Publication Data

US 2022/0090314 A1 Mar. 24, 2022

(30) Foreign Application Priority Data

Jan. 30, 2019 (JP) ..... 2019-013975

(51) Int. Cl.
*D06M 13/213* (2006.01)
*A41D 31/10* (2019.01)
(Continued)

(52) U.S. Cl.
CPC ..... *D06M 13/213* (2013.01); *D03D 15/00* (2013.01); *D03D 15/283* (2021.01); *D03D 15/37* (2021.01);
(Continued)

(58) Field of Classification Search
None
See application file for complete search history.

(56) References Cited

U.S. PATENT DOCUMENTS 6,093,491 A * 7/2000 Dugan ..... D01F 8/14 428/397
2002/0187330 A1* 12/2002 Rohrbach ..... H05K 9/0083 428/297.4
(Continued)

FOREIGN PATENT DOCUMENTS

CN 107447523 A 12/2017
JP 06235167 A 8/1994
(Continued)

OTHER PUBLICATIONS

International Search Report and Written Opinion for International Application No. PCT/JP2020/002063, dated Apr. 7, 2020, 5 pages.
(Continued)

*Primary Examiner* — Marla D McConnell
*Assistant Examiner* — Kevin Worrell
(74) *Attorney, Agent, or Firm* — Buchanan Ingersoll & Rooney PC

(57) ABSTRACT

The present invention provides a water-repellent woven or knitted article that overcomes the problems of the related art and exhibits water-repellent properties and is excellent in abrasion resistance and durability. The water-repellent woven or knitted article of the present invention is a woven or knitted article subjected to a water repellent treatment using a water repellent having a perfluorooctanoic acid (PFOA) concentration of 5 ng/g or less, wherein the woven or knitted article includes, as constituent fibers, fibers having a transverse cross-sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of the fiber, a droplet contact angle between the woven or knitted article and water is 135° or more after 20 times of washing in accordance with a method of JIS L 0217
(Continued)

103 and a water repellency is grade 4 or more in accordance with a spray method of JIS L 1092.

8 Claims, 4 Drawing Sheets

(51) Int. Cl.

| | |
|---|---|
| ***D03D 15/00*** | (2021.01) |
| ***D03D 15/283*** | (2021.01) |
| ***D03D 15/37*** | (2021.01) |
| ***D06M 15/643*** | (2006.01) |

(52) U.S. Cl.
CPC ..... *D06M 15/643* (2013.01); *A41D 31/10* (2019.02); *D06M 2200/12* (2013.01)

(56) References Cited

U.S. PATENT DOCUMENTS

| | | | | |
|---|---|---|---|---|
| 2004/0127129 | A1 | 7/2004 | Luo et al. | |
| 2013/0344761 | A1* | 12/2013 | Williams | D01F 8/00 264/103 |

FOREIGN PATENT DOCUMENTS

| | | | | |
|---|---|---|---|---|
| JP | 2000178834 | A | | 6/2000 |
| JP | 2005350828 | A | | 12/2005 |
| JP | 2010138510 | A | | 6/2010 |
| JP | 2015221952 | A | | 12/2015 |
| JP | 2018012899 | A | * | 1/2018 |
| JP | 2018197403 | A | | 12/2018 |
| JP | 2020105682 | A | | 7/2020 |
| WO | 9921507 | A2 | | 5/1999 |
| WO | 2012008548 | A1 | | 1/2012 |

OTHER PUBLICATIONS

Chinese Office Action with Search Report for Chinese Application No. 202080010110.X, dated Nov. 15, 2022 with translation, 9 pages.

Extended European Search Report for European Application No. 20749220.8, dated Apr. 5, 2023, 6 pages.

* cited by examiner

WATER-REPELLENT WOVEN OR KNITTED ARTICLE, PRODUCTION METHOD FOR SAME, AND GARMENT

CROSS REFERENCE TO RELATED APPLICATIONS

This is the U.S. National Phase application of PCT/JP2020/002063, filed Jan. 22, 2020, which claims priority to Japanese Patent Application No. 2019-013975, filed Jan. 30, 2019, the disclosures of each of these applications being incorporated herein by reference in their entireties for all purposes.

FIELD OF THE INVENTION

The present invention relates to a woven or knitted article, and relates to a highly durable water-repellent woven or knitted article which can maintain excellent water repellent properties even after being washed.

BACKGROUND OF THE INVENTION

The water-repellent woven or knitted article is obtained by subjecting the woven or knitted article to a water repellent treatment. The water-repellent woven or knitted article is used for various applications such as outdoor wears for mountaineering, ski wears, windbreakers, and swimsuits, and all of them are required to have high water repellent properties.

In order to impart water repellent properties to these woven or knitted articles, for example, a fluorine-based water repellent, a silicone-based water repellent, a paraffin-based water repellent, or the like is used. Particularly, the fluorine-based water repellent has excellent initial water-repellent properties and also has durability of water-repellent properties to washing, and thus is currently used in various textile products.

In the water repellent treatment using the fluorine-based water repellent, a so-called C8 water repellent, i.e., a fluorine-based compound having a perfluoroalkyl group having 8 or more carbon atoms, has been used because the water-repellent properties are high. However, the C8 water repellent contains perfluorooctanoic acid (PFOA) as an impurity, and is hardly decomposed due to the stability of its chemical structure, and it is pointed out that the accumulation of the water repellent in the human body and the remaining of the water repellent in the external environment cause an adverse effect. Accordingly, it is accelerating the use of a PFOA-free fluorine-based water repellent having 6 or less carbon atoms (C6 water repellent) as an alternative.

In recent years, with increasing interest for further reducing environmental load, the replacement with a non-fluorine-based water repellent that does not contain a fluorine compound mainly composed of a perfluoroalkyl group has been advanced in the fiber industry. Meanwhile, in the C6 water repellent and the non-fluorine-based water repellent, the regular arrangement of molecules in the water-repellent film is easily disturbed, and the water-repellent properties and the durability thereof are not sufficient unless various water repellent treatment conditions and processes are optimized. Therefore, in a water-repellent material treated using a PFOA-free water repellent, a technique for improving initial water-repellent properties and durability thereof has been developed.

Textile processing techniques such as chemical composition of water repellents and processing conditions for enhancing durability have been studied so far (e.g., Patent Document 1). In addition to this, studies have been conducted on the formation of a modified cross-section fiber, aiming at a so-called lotus leaf effect in which the initial water-repellent properties and durability thereof are improved by controlling the surface form of the woven or knitted article (e.g., Patent Document 2).

PATENT DOCUMENTS

Patent Document 1: Japanese Patent Laid-open Publication No. 2015-221952

Patent Document 2: Japanese Patent Laid-open Publication No. 2005-350828

SUMMARY OF THE INVENTION

However, in the technique described in Patent Document 1, the water-repellent properties are greatly reduced after 20 times of washing, and a woven or knitted article having excellent durability of the water-repellent properties is not obtained when a PFOA-free water repellent is used. In the technique described in Patent Document 2, the abrasion resistance and the durability of the water-repellent properties under dry conditions are excellent, but there is no consideration to the abrasion resistance in a wet state which is a more severe condition. In this technique, for example, in an environment in which the movement (for example, when sportswear or the like is put on) is strenuous and the wear gets wet, strong friction is repeatedly applied, whereby the modified cross-section fiber for exhibiting the water-repellent properties is crushed, and the water-repellent properties may be significantly reduced.

As described above, in many of the conventionally proposed fibers having a specific cross section, durability against friction in actual use is not considered, and problems remain in actual use. Therefore, there is a demand for the development of a woven or knitted article capable of maintaining high durability in water-repellent properties in which these technical problems have been solved.

An object of the present invention is to provide a water-repellent woven or knitted article that overcomes the problems of the related art and exhibits water-repellent properties and is excellent in abrasion resistance and durability.

In order to solve the above problems, the present invention according to exemplary embodiments has the following configuration.

(1) A water-repellent woven or knitted article that is a woven or knitted article subjected to a water repellent treatment using a water repellent having a perfluorooctanoic acid concentration of 5 ng/g or less, wherein the woven or knitted article includes, as constituent fibers, fibers having a transverse sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber, a droplet contact angle between the woven or knitted article and water is 135° or more after 20 times of washing in accordance with a method of JIS L 0217 103 and a water repellency is grade 4 or more in accordance with a spray method of JIS L 1092.

(2) A water-repellent woven or knitted article that is a woven or knitted article with a water repellent attached, wherein the water repellent contains only a fluorine-based water repellent composed of a fluorine compound having a perfluoroalkyl group having 6 or less carbon atoms or a non-fluorine-based water repellent, the woven or knitted article includes, as constituent fibers, fibers having a transverse sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber, a droplet contact angle between the woven or knitted article and water is 135° or more after 20 times of washing in accordance with a method of JIS L 0217 103 and a water repellency is grade 4 or more in accordance with a spray method of JIS L 1092.

(3) The water-repellent woven or knitted article according to (1) or (2), wherein a degree of discoloration after a friction test under wet conditions is grade 4 or more.

(4) The water-repellent woven or knitted article according to any one of (1) to (3), wherein the water repellent is a water repellent mainly composed of a silicone-based or paraffin-based compound.

(5) A garment comprising at least a part of the water-repellent woven or knitted article according to any one of (1) to (4).

(6) A method for producing the water-repellent woven or knitted article according to any one of (1) to (4), including subjecting a woven or knitted article to a water repellent treatment using a water repellent having a perfluorooctanoic acid concentration of 5 ng/g or less, wherein the woven or knitted article includes, as constituent fibers, fibers having a transverse sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber.

(7) The method for producing the water-repellent woven or knitted article according to (6), wherein a non-fluorine-based water repellent is used as the water repellent.

(8) The method for producing the water-repellent woven or knitted article according to (6) or (7), wherein a water repellent mainly composed of a silicone-based or paraffin-based compound is used as the water repellent.

According to the present invention, it is possible to provide a woven or knitted article that exerts water-repellent properties with excellent durability and is also excellent in abrasion resistance since the woven or knitted article includes fibers having specific grooves as constituent fibers. This woven or knitted article is used for garment applications, so that it is possible to obtain a garment that exhibits water-repellent properties with excellent durability and is also excellent in abrasion resistance. Particularly, the present invention can be very practically used for sportswear which is used in a relatively severe atmosphere, for example, in a snowy mountain or on the ice (e.g., climbs, skis, skates, and the like); outerwear for civil engineering works or the like; and wear frequently exposed to scratching.

DETAILED DESCRIPTION OF EMBODIMENTS OF THE INVENTION

Hereinafter, the present invention will be described in detail.

The water-repellent woven or knitted article according to an embodiment of the present invention is a woven or knitted article subjected to a water repellent treatment using a water repellent having a perfluorooctanoic acid (PFOA) concentration of 5 ng/g or less.

Figure 1:
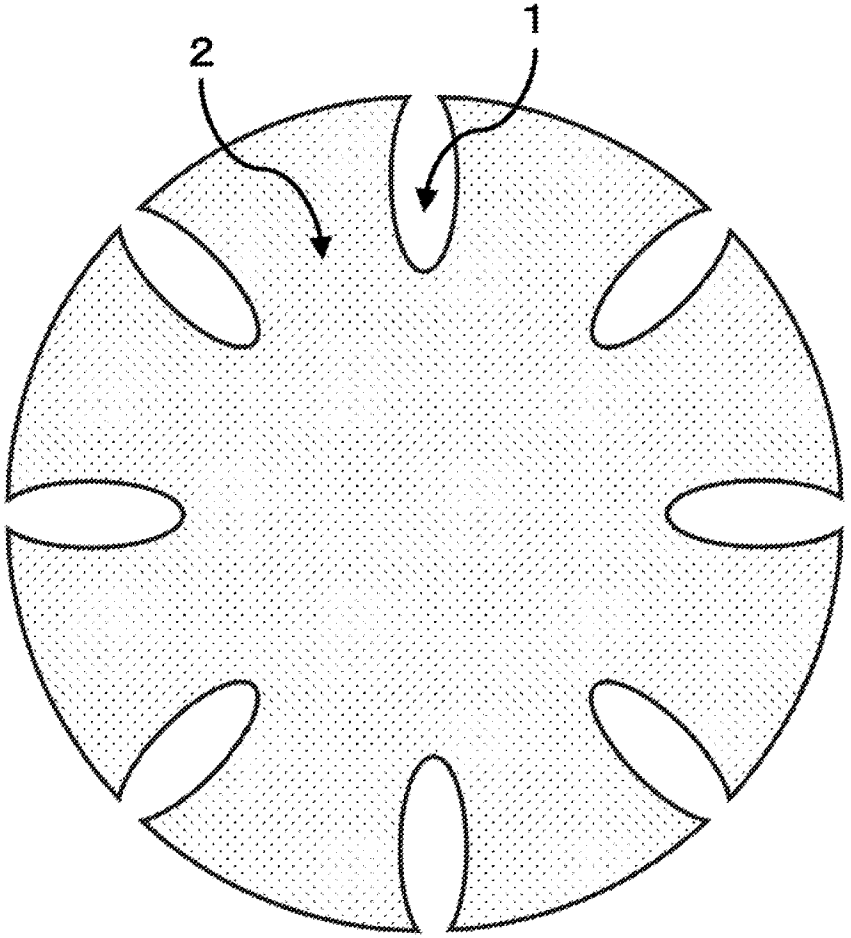
FIG. 1 is an outline view for explaining a transverse sectional shape of a fiber used in an embodiment of the present invention.

The water-repellent woven or knitted article according to an embodiment of the present invention includes, as constituent fibers, fibers having a transverse cross-sectional shape, each fiber has a plurality of grooves at an outer circumference of the transverse cross section, each groove has a wide part (hereinafter, sometimes referred to as "specific cross-section fiber") As illustrated in FIG. 1, a specific cross-section fiber is a fiber having a modified cross-section shape, like a specific cross-section fiber 2 (2 of FIG. 1) in which a plurality of grooves 1 (1 of FIG. 1) is formed at the outer circumference, and each groove has a wide part. Further, it is necessary that a groove entrance width (w1) 3, a groove wide part width (w2) 4, and a groove depth (h) 5 with respect to a diameter of specific cross section fiber (d) satisfy the following Formulae, which satisfy the following Formulae 1 and 2:

$$w2/w1 \geq 1.3 \quad \text{(Formula 1)}$$

$$0.15 \leq h/d \leq 0.25 \quad \text{(Formula 2)}$$

Examples of the polymer constituting the specific cross-section fiber used in an embodiment of the present invention include melt-moldable polymers such as polyethylene terephthalate, polyethylene naphthalate, polybutylene terephthalate, polytrimethylene terephthalate, polypropylene, polyolefin, polycarbonate, polyacrylate, polyamide, polylactic acid, thermoplastic polyurethane, and polyphenylene sulfide, and copolymers thereof. Particularly, when the melting point of the polymer is 165° C. or more, the heat resistance is good, which is preferable. Further, the polymer may contain various additives such as inorganic substances such as titanium oxide, silica, and barium oxide; colorants such as carbon black, dyes, and pigments; flame retardants; fluorescent brighteners; antioxidants; and ultraviolet absorbers.

The specific cross-section fiber used in an embodiment of the present invention has a specific groove having a portion with a narrow entrance and a wide depth (the wide part of the groove). In nature, as represented by lotus leaves, a water-repellent structure exists in which water-repellent properties are obtained by introducing an air layer between a water droplet and the surface of the fiber by fine protrusions on the surface without depending on chemical substances such as fluorine. Various proposals using ultrafine fibers and the like have been made utilizing this phenomenon, but there are concerns that the structure is disturbed by external force such as washing, leading to a reduction in properties. Meanwhile, since the specific cross-section fiber of the present invention stably forms a structure in which the air layer can be introduced into each fiber, the structure can be maintained even in the case of external force such as washing. Further, since the groove shape is maintained, the groove inside is not exposed to scratching or the like from the outside, a water repellent finishing agent that has permeated the groove inside is less likely to fall off, and the properties can be maintained. The shape will be described in detail below.

In the specific cross-section fiber of the present invention, the groove entrance width (w1), the groove wide part width (w2), and the groove depth (h) with respect to the diameter of specific cross section fiber (d) are important, and become the first requirement. Here, since the ratio between the groove wide part width (w2) and the groove entrance width (w1) is 1.3 or more, when a water droplet comes into contact with the fiber, the water droplet is less likely to enter the groove due to the narrow groove entrance. Further, since the introduced air acts to push up the water droplet, the air layer can be maintained, and thus a water repellent effect can be obtained. The ratio is preferably 1.5 or more, and more preferably 1.8 or more. Further, in order to suppress cracking of the protrusion and maintain the contour (edge) of the shape of the groove entrance, the ratio is preferably 3.0 or less. This contour is maintained, so that it is possible to maintain the water-repellent properties.

In addition, it is necessary that the ratio (h/d) of the groove depth (h) to the diameter of specific cross section fiber (d) is 0.15 or more. Thus, even if the water droplet is subjected to its own weight or water pressure, the water droplet does not reach the depth of the groove, and the properties are maintained. From the viewpoint of water droplet intrusion, the larger the value of the ratio is, the better it is. However, the upper limit of the value is set to 0.25 or less in an embodiment of the present invention because the properties may be reduced due to deformation or destruction of the protrusion forming the groove when receiving an external force. The value is preferably 0.17 or more and less than 0.22.

Furthermore, the groove depth (h) also contributes to water-repellent properties, and the absolute value thereof is preferably 2 μm or more, and more preferably 3 μm or more. In general, for example, in the case of single fibers having a size of about 50 to 150 dtex, the diameter of one single fiber is in a range of about 10 to 23 μm, whereas the size of raindrops is excessively large and is in a range of about 100 to 1000 μm. Thus, the water droplets attached to the fiber enters the groove by their own weight. When the water droplets reach the bottom surface (bottom portion) of the groove, the water droplets are attached thereto and the fiber gets wet. However, in a case in which the groove is deep, the groove is pushed up by surface tension of water droplets, and the fiber exhibits water-repellent properties without being wet. Here, in order to exhibit water-repellent properties by utilizing the surface tension of water droplets, the groove depth is preferably 2 μm or more as described above.

Figure 2:
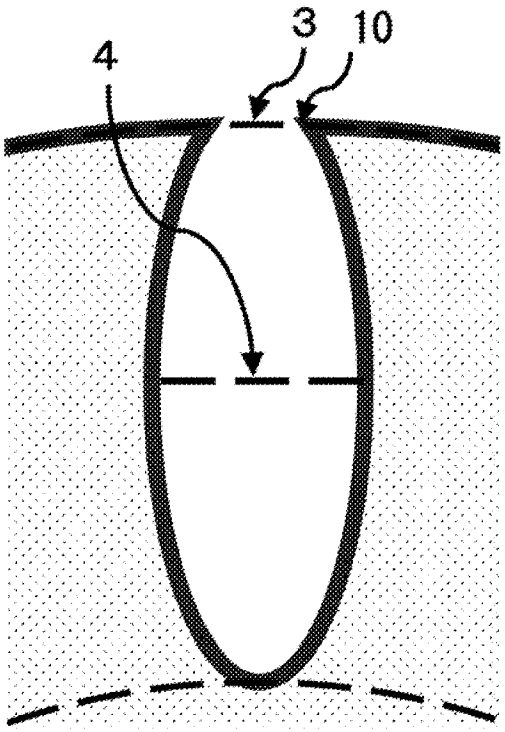
FIG. 2 is an enlarged schematic view for explaining a groove in the transverse section of the fiber used in an embodiment of the present invention.
Figure 4:
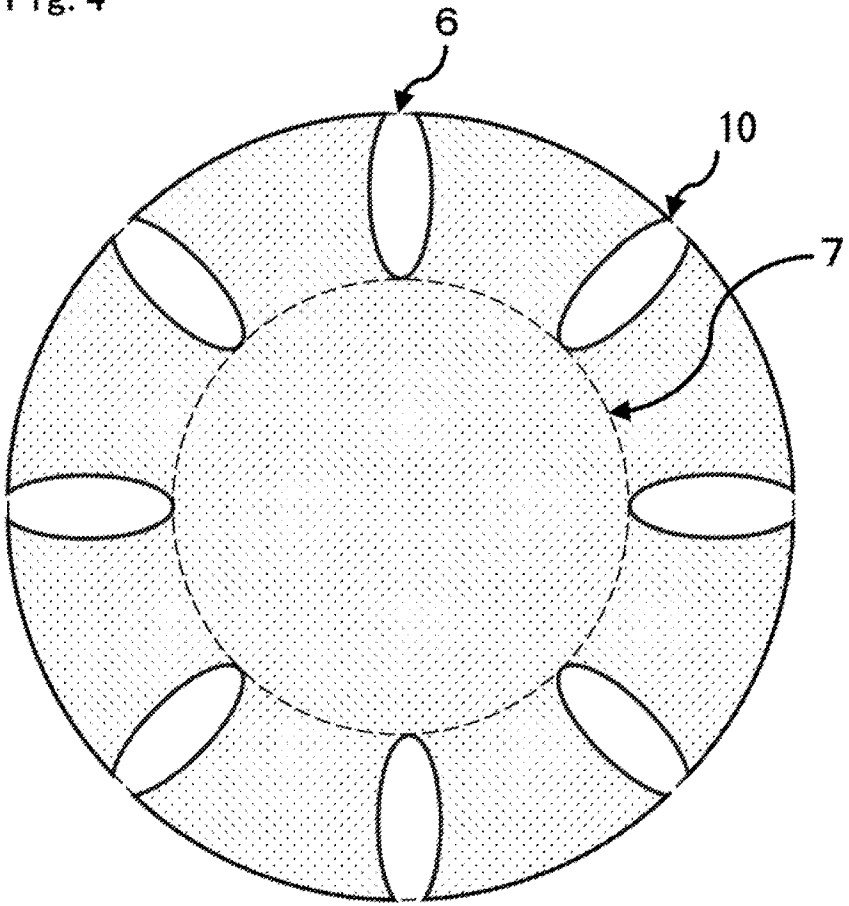
FIG. 4 is a schematic view for explaining protrusions in the transverse section of the fiber used in an embodiment of the present invention.
Figure 3:
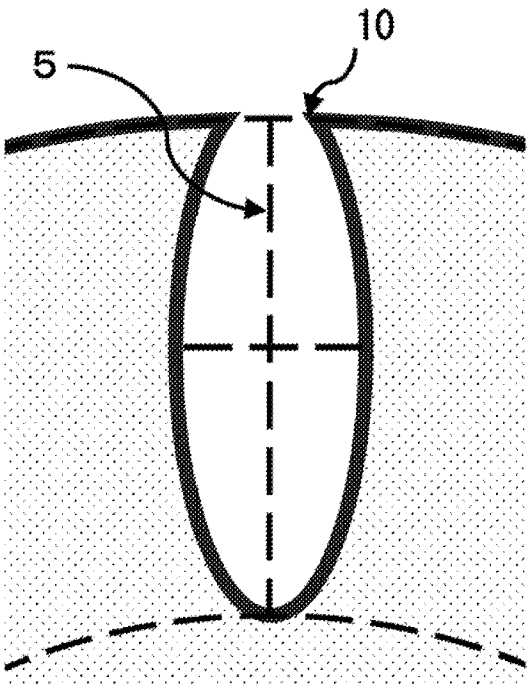
FIG. 3 is an enlarged schematic view for explaining the groove depth in the transverse section of the fiber used in an embodiment of the present invention.

Next, the groove entrance width (w1), the groove wide part width (w2), the diameter of specific cross section fiber (d), and the groove depth (h) are determined as follows. That is, the groove entrance width (w1) is the minimum section when the length orthogonal to the center line of the groove in the fiber cross section in the direction perpendicular to the fiber axis is measured toward the outer circumference along the center line (3 in FIG. 2). Further, the groove wide part width (w2) (4 in FIG. 2) is the maximum section when the length orthogonal to the center line of the groove is measured toward the center of the fiber from the outer circumference along the center line. The diameter of the circumscribed circle of the protrusion 10 is defined as the diameter of specific cross section fiber (d). Further, the groove depth (h) means a distance between intersections of the circumscribed circle of the protrusion and the inscribed circle of the groove at the center line of the groove (5 in FIG. 3). The term "circumscribed circle" used herein is a perfect circle circumscribed most frequently at two or more points on the tip of the protrusion in the cross section of the specific cross-section fiber, i.e., a circumscribed circle of the protrusion (6 in FIG. 4), and the term "inscribed circle" means a perfect circle inscribed most frequently at two or more points on the tip (bottom) of the groove, i.e., an inscribed circle of the groove (7 in FIG. 4).

In the specific cross-section fiber according to an embodiment of the present invention, the number of grooves 1 (1 in FIG. 1) is preferably in a range of 4 to 9, and more preferably in a range of 6 to 8. The number of grooves is set to 4 or more, the contact area between the water droplet and the fiber surface can be effectively reduced, and excellent water repellent properties are exhibited. When the number of grooves is set to 9 or less, the protrusions are less likely to be cracked, and it is possible to obtain a water-repellent woven or knitted article excellent in abrasion resistance even under more severe wet conditions. As a result, the deterioration in quality when used as a garment can be suppressed, and the durability of the water-repellent properties becomes excellent by maintaining a specific cross-sectional shape even under severe conditions.

In embodiments of the present invention, it is desirable to use a sheath/core conjugate fiber in order to obtain a specific cross-section fiber as described later. The term "sheath/core conjugate fiber" in the present invention refers to a fiber composed of two types of polymers and having a specific cross-sectional form in which a plurality of grooves is present in the cross section of the core component and each groove has a wide part. When the sheath/core conjugate fiber is used for a woven or knitted article, the fiber is basically subjected to an elution operation. Thus, in the sheath/core conjugate fiber, the area proportion of the core component in the cross section of the fiber is preferably set to a range of 50% to 90%. When the area proportion is within such a range, for example, even in the case of forming a woven fabric, voids between fibers become moderate, and the woven fabric can be used without being mixed with other fibers. From the viewpoint of shortening the elution treatment time, it is preferable to reduce the area proportion of the sheath component, and from this viewpoint, the area proportion of the core component is more preferably in a range of 70% to 90%, and particularly preferably in a range of 80% to 90%.

In the sheath/core conjugate fiber, the area proportion of the core component can exceed 90%, but the upper limit of the area proportion is set to 90% as a range in which, substantially, the sheath component can stably form the groove.

Elution of the sheath component in the sheath/core conjugate fiber is generally often performed using a jet dyeing machine or the like. In the processing step, the fiber is repeatedly subjected to complicated deformation. In this case, the protrusion formed in the outermost layer of the fiber is repeatedly subjected to complicated deformation. When the mechanical durability against this deformation is low, the protrusion is easily peeled off. In such a case, not only the texture is reduced due to fluffing of the fiber, but also the function expressed by the groove shape is extremely reduced, and the expected effect has sometimes not been obtained. This durability is due to the large movable range of the protrusion, and depends on the relationship between the protrusion top width and the groove width. When a width between adjacent protrusion tops is Pout and a width of an entrance of a groove is w1, a ratio of Pout/w1 is preferably 2.0 or more and 10.0 or less. When the ratio is in such a range, of course, the durability during the elution treatment described above is maintained, and the protrusions after elution are present independently. Thus, the function works very effectively depending on the groove shape, and various properties can be exhibited by the protrusions (grooves) formed on the fiber surface layer. Further from such a viewpoint, the larger the value of the ratio of Pout/w1 is, the better the durability becomes. In consideration of producing a sheath/core conjugate fiber having excellent durability, the ratio of Pout/w1 is preferably 3.0 or more and 10.0 or less. In addition, when the sheath/core conjugate fiber is used for outerwear for sports exposed to a relatively severe atmosphere or inner wear frequently exposed to scratching, the ratio of Pout/w1 is particularly preferably 4.0 or more and 10.0 or less, and in such a range, the properties caused by the groove is maintained with high durability.

Figure 5:
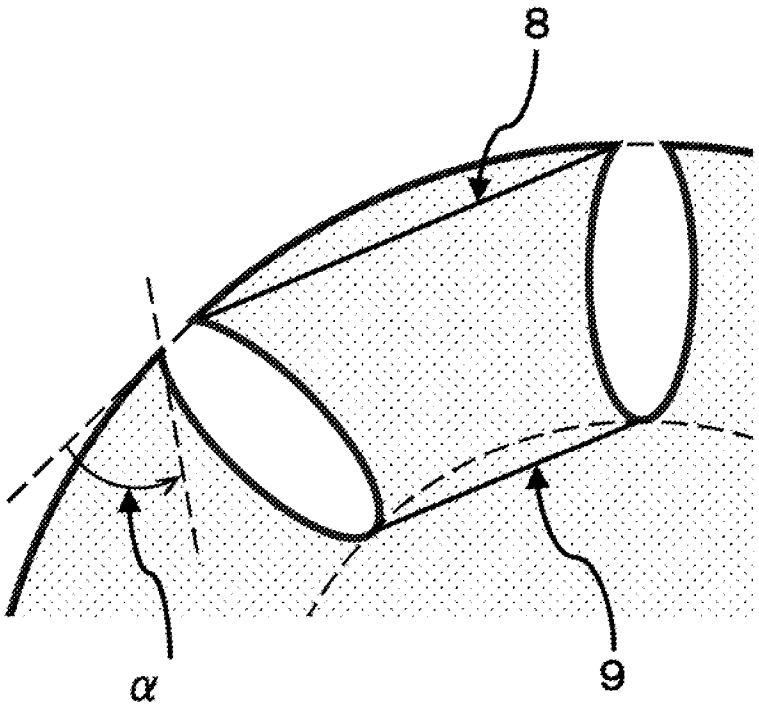
FIG. 5 is an enlarged schematic view for explaining protrusions in the transverse section of the fiber used in an embodiment of the present invention.

Further, even when stress such as scratching is applied to the independent protrusions, the protrusions hardly move. For this reason, the dynamic deterioration of the protrusions hardly occurs, and the durability at the time of actual use is also greatly affected. When attention is paid to the water-repellent properties, it is necessary to introduce an air layer into the groove, and thus the ratio (Pout/Pmin) of the protrusion top width (Pout) to the protrusion bottom width (Pmin) is preferably 1.3 or more. More preferably, the ratio is 2.3 or more. The term "protrusion top width (Pout)" used herein means a distance (8 in FIG. 5) between spots corresponding to contact points on the circumscribed circle of the grooves adjacent to each other with the protrusion 10 interposed therebetween, and the term "protrusion bottom width (Pmin)" means a distance (9 in FIG. 5) between spots corresponding to contact points on the inscribed circle of the grooves adjacent to each other with the protrusion 10 interposed therebetween. It is preferable that the larger the ratio of Pout/Pmin is, from the viewpoint of water-repellent properties, but this is disadvantageous from the viewpoint of durability. Thus, the ratio is preferably less than the practicable upper limit value (5.0) in the present invention. More preferably, the ratio is less than 4.5.

The specific cross-section fiber used in the water-repellent woven or knitted article according to an embodiment of the present invention exhibits water-repellent properties due to the specific groove shape as described above, and it is desirable to maintain the groove shape for maintaining the durability. Thus, the original yarn is formed into a sheath/core conjugate fiber, whereby even if the cross section of the yarn is strongly deformed in a yarn processing step such as a twisting step or a false twisting step, a desired groove shape can be obtained by subsequent elution, which is preferable. Further, this is preferable since the contour (edge) of the shape of the groove entrance can be maintained. Maintaining this contour greatly contributes to maintaining the water repellent properties, and the protrusion forming the groove entrance preferably has an acute angle. The term "acute angle" as used herein means that the angle (a in FIG. 5) formed by the tangent of the side of the fiber surface of the protrusion in the protrusion and the tangent of the side of the groove in the protrusion is less than 90 deg. The acute angle is preferably 80 deg or less. It is considered that the protrusion has an acute angle as described above, so it is possible to suppress the entry of water droplets into the groove. Furthermore, even in the form of a woven or knitted article, since elution occurs after the woven or knitted article is formed, a gap between yarns can be appropriately maintained, and the securing of the air layer can contribute to the maintenance of water-repellent properties.

The transverse sectional shape of the sheath/core conjugate fiber can be various cross-sectional shapes such as a flat cross section in which the ratio of the minor axis to the major axis (ellipticity) is larger than 1.0, a polygonal cross section such as a triangle, a square, a hexagon, or an octagon, a daruma-shaped cross section partially having irregularities, a Y-shaped cross section, and a star-shaped cross section, in addition to a perfect circular cross section.

In the present invention, when the water-repellent woven or knitted article is a woven fabric, it is preferable that the specific cross-section fiber is used for at least one of the warp yarn and the weft yarn of the woven fabric.

Further, the cover factor represented by (Formula 3) preferably satisfies the following range:

$$\text{Yarn density(yarns/2.54 cm)} \times \text{fineness (decitex)}^{0.5} \leq 1400 \quad \text{(Formula 3)}$$

where the yarn density is a yarn density of the warp yarn or the weft yarn in the specific cross-section fiber, and the fineness is a total fineness of the specific cross-section fiber.

More preferably, $$200 \leq \text{yarn density(yarns/2.54 cm)} \times \text{fineness (decitex)}^{0.5} \leq 1400 \quad \text{(Formula 4)},$$

and more preferably $$300 \leq \text{yarn density(yarns/2.54 cm)} \times \text{fineness (decitex)}^{0.5} \leq 1400 \quad \text{(Formula 5)}.$$

As the water repellent, a water repellent having a perfluorooctanoic acid (PFOA) concentration of 5 ng/g or less as measured with a high-performance liquid chromatograph-mass spectrometer (LC-MS) is used. Preferably, the concentration is less than 1 ng/g. When the concentration is larger than 5 ng/g, it is not environmentally preferable. Examples of the water repellent include a C6 water repellent (also referred to as "C6-based water repellent", but herein referred to as "C6 water repellent") and a non-fluorine-based water repellent. The term "C6 water repellent" refers to a fluorine-based water repellent including a fluorine-based compound having a perfluoroalkyl group, where the perfluoroalkyl group has 6 or less carbon atoms. The term "perfluoroalkyl group" refers to a group in which two or more hydrogen atoms of an alkyl group are substituted with fluorine atoms. The non-fluorine-based water repellent is a water repellent that does not contain a fluorine compound mainly composed of a perfluoroalkyl group. Examples of the non-fluorine-based water repellent include a silicone-based water repellent and a paraffin-based water repellent, and these water repellents may be mainly composed of a silicone-based compound or may be mainly composed of a paraffin-based compound.

As the C6 water repellent that satisfies the condition of the perfluorooctanoic acid (PFOA) concentration, a commercially available product can be preferably used, and examples thereof include "AsahiGuard" AG-E082 (manufactured by Meisei Chemical Works, Ltd.). The concentration of the C6 water repellent to be attached is preferably in a range of 1 wt % to 10 wt %. The upper limit is more preferably 8 wt % or less, still more preferably 6 wt % or less, and most preferably 5 wt % or less. The lower limit is more preferably 2 wt % or more, and still more preferably 3 wt % or more.

As the non-fluorine-based water repellent that satisfies the condition of the perfluorooctanoic acid (PFOA) concentration, a commercially available product can be preferably used, and examples thereof include "NEOSEED" NR-158 (a water repellent mainly composed of a silicone-based compound, manufactured by NICCA CHEMICAL CO., LTD.). The concentration of the non-fluorine-based water repellent to be attached is preferably in a range of 1 wt % to 10 wt %. The upper limit is more preferably 8 wt % or less, still more preferably 6 wt % or less, and most preferably 5 wt % or less. The lower limit is more preferably 2 wt % or more, and still more preferably 3 wt % or more.

In order to improve the durability of the water-repellent properties, the water repellent is preferably used in combination with a cross-linker. As the cross-linker, at least one of a melamine-based resin, a blocked isocyanate-based compound (polymerization), a glyoxal-based resin, and an imine-based resin can be used, and the cross-linker is not particularly limited.

Hereinafter, an example of a method for producing the water-repellent woven or knitted article of the present invention will be described in detail.

The specific cross-section fiber used in the present invention can be obtained by using two types of polymers, spinning sheath/core conjugate fibers arranged so as to form grooves with a specific cross-section fiber component (core component) and an elution component (sheath component), knitting or weaving the fibers, and then dissolving the sheath component by an elution treatment to allow the core component to remain. Here, the sheath/core conjugate fibers are preferably spun by a composite spinning method based on melt spinning from the viewpoint of increasing the productivity. Of course, it is also possible to obtain sheath/core conjugate fibers by solution spinning or the like.

When melt spinning is selected, examples of the core component and the sheath component include melt-moldable polymers such as polyethylene terephthalate, polyethylene naphthalate, polybutylene terephthalate, polytrimethylene terephthalate, polypropylene, polyolefin, polycarbonate, polyacrylate, polyamide, polylactic acid, thermoplastic polyurethane, and polyphenylene sulfide, and copolymers thereof. Particularly, when the melting point of the polymer is 165° C. or more, the heat resistance is good, which is preferable. Further, the polymer may contain various additives such as inorganic substances such as titanium oxide, silica, and barium oxide; colorants such as carbon black, dyes, and pigments; flame retardants; fluorescent brighteners; antioxidants; and ultraviolet absorbers.

In order to form grooves, an easy-to-elute component as the sheath component is eluted from the sheath/core conjugate fibers. Specifically, the sheath component may be removed by immersing the fibers in a solvent or the like in which the easy-to-elute component can be dissolved. When the easy-to-elute component is copolymerized polyethylene terephthalate which has been copolymerized with 5-sodium sulfoisophthalic acid, polyethylene glycol, or the like, or polylactic acid, it is possible to use an alkaline aqueous solution such as a sodium hydroxide solution. As a method for treating the sheath/core conjugate fibers with an alkaline aqueous solution, for example, conjugate fibers are formed or a fiber structure is formed from the conjugate fibers, followed by immersion in the alkaline aqueous solution. At this time, the alkaline aqueous solution is heated to 50° C. or more, so it is possible to accelerate the progress of hydrolysis, and this is preferable. Further, when a fluid dyeing machine or the like is used, a large amount of the fibers can be treated at a time, and thus the productivity is good, and this is preferable from the industrial viewpoint.

It is preferable that the core component is hardly eluted and the sheath component is easily eluted with respect to the solvent used for eluting the sheath component. Preferably, the core component is selected according to the application, a usable solvent is considered based on the selected result, and the sheath component is selected from the above-described polymers.

It can be said that the larger the elution speed ratio between the hard-to-elute component (core component) and the easy-to-elute component (sheath component) in the sheath/core conjugate fiber with respect to the solvent is, the more preferable the combination is. The elution speed ratio is preferably 10 times or more, and it is preferable to select a polymer with the elution speed ratio in the range of up to 3000 times as a guide. The elution speed ratio is more preferably 100 times or more, and still more preferably 1000 times or more. The sheath component is preferably selected from melt-moldable polymers more soluble than other polymers, such as polyester and copolymers thereof, polylactic acid, polyamide, polystyrene and copolymers thereof, polyethylene, and polyvinyl alcohol. In particular, from the viewpoint of simplifying the elution step of the sheath component, the sheath component is preferably a copolymerized polyester, polylactic acid, polyvinyl alcohol, or the like that is soluble in an aqueous solvent, hot water, or the like. Particularly, it is preferable to use a polyester copolymerized singly or in combination with polyethylene glycol or sodium sulfoisophthalic acid, or polylactic acid, from the viewpoint of handleability and easy dissolution in a low concentration aqueous solvent.

In addition, from the viewpoint of the solubility with respect to the aqueous solvent and the simplification of the treatment of the waste liquid generated at the time of elution, it is particularly preferable to use polylactic acid, a polyester in which 3 mol % to 20 mol % of 5-sodium sulfoisophthalic acid is copolymerized, and a polyester in which 5 wt % to 15 wt % of polyethylene glycol having a weight-average molecular weight of 500 to 3000 is copolymerized in addition to 5-sodium sulfoisophthalic acid described above. In particular, the polyester obtained by copolymerizing 5-sodium sulfoisophthalic acid alone and polyethylene glycol in addition to 5-sodium sulfoisophthalic acid described above is soluble in an aqueous solvent such as an alkaline aqueous solution while maintaining the crystallinity. Thus, the polyester is preferable from the viewpoint of textile processing passability without causing fusion between conjugate fibers even in false twist processing or the like to which scratching is applied under heating.

The spinning temperature in the present invention is preferably a temperature at which a polymer having a high melting point or a high viscosity, among the usable polymers determined from the viewpoint described above, exhibits fluidity. The temperature at which the polymer exhibits fluidity varies depending on the polymeric properties and the molecular weight of the polymer. The melting point of the polymer is used as a guide, and the temperature may be set at a temperature equal to or less than the melting point plus 60° C. When the temperature is equal to or less than the above temperature, the polymer is not thermally decomposed at the time of spinning, a decrease in molecular weight is suppressed, and the sheath/core conjugate fibers can be favorably produced.

The sheath/core conjugate fiber used in exemplary embodiments of the present invention is composed of filament yarns. The filament yarns include drawn yarns and various twisted yarns. The type of the twisted yarns is not particularly limited, and examples thereof include false-twisted yarns, false-twisted fused yarns, and medium-hard twisted yarns.

The specific cross-section fiber used in the present invention can be woven or knitted by an ordinary method, and can be dyed by an ordinary method.

When the woven or knitted article is a woven fabric, the weave structure is not particularly limited, and examples thereof include plain weave, twill weave, satin weave, modified plain weave, modified twill weave, modified satin weave, variable weave, Jacquard weave, double weave, double weave structure, multiple weave structure, warp pile weave, weft pile weave, and gauze weave. Further, when the woven or knitted article is a knit fabric, the knitting structure is not particularly limited, and examples thereof include circular knitting, weft knitting, warp knitting (including tricot knitting and raschel knitting), pile knitting, plain knitting, jersey knitting, rib knitting, smooth knitting (interlock knitting), rib knitting, pearl knitting, denbigh structure, cord structure, atlas structure, chain structure, and inlay structure. Although both the woven fabric and the knit fabric may have any structure, the droplet contact angle and the water repellency tend to be larger in the case of forming a structure in which irregularities are easily formed, such as a twill weave, as compared to the case of forming a plain weave. In the case of being used together with other cross-section fibers, there is desired a structure in which a large amount of specific cross-section fibers appear on the surface.

When the sheath/core conjugate fiber is eluted to form the specific cross-section fiber of the present invention and the resulting fiber is used as a woven or knitted article, water repellent finishing is performed. If necessary, antistatic finishing, flame-retardant finishing, hygroscopic finishing, antistatic finishing, antibacterial finishing, flexible finishing, and other known post-processing (including resin coating, film lamination, processing for imparting other functions, and the like) can be used in combination, and it is possible to improve the washing durability of the functional processing agents such as an antistatic agent, a flame retardant, a hygroscopic agent, an antistatic agent, an antibacterial agent, and a fabric softener. The water-repellent finishing step is, for example, a padding method, a spraying method, a coating method, or the like, and it is not particularly limited.

In the water-repellent woven article or knitted article according to an embodiment of the present invention, a droplet contact angle between the woven or knitted article and a water droplet is 135° or more, preferably 140° or more, and more preferably 145° or more. The droplet contact angle is an angle formed by a surface of a horizontally stretched woven or knitted article and a water droplet dropped on the surface of the woven or knitted article. The larger the contact angle is, the better the water repellent properties are, which is used as an indicator. In the present invention, 3 μL of water droplets are dropped on the surface of the woven or knitted article using a fully automatic contact angle meter (DM-SA, manufactured by Kyowa Interface Science Co., Ltd.), and the droplet contact angle is measured by a tangent method. When the droplet contact angle is less than 135°, sufficient water repellent properties are not achieved, and water droplets are likely to remain on the woven or knitted article.

The water-repellent woven fabric according to an embodiment of the present invention has excellent durability to washing, thereby achieving a droplet contact angle between the woven or knitted article and a water droplet of 135° or more after 20 times of washing in accordance with the method of JIS L 0217 103. In a preferred embodiment, it is also possible to achieve a droplet contact angle of 140° or more, and further achieve a droplet contact angle of 145° or more.

In the water-repellent woven or knitted article according to an embodiment of the present invention, the water repellency (grade) is grade 4 or more in accordance with the spray method of JIS L 1092, after 20 times of washing in accordance with the method of JIS L 0217 103. In general, the water-repellent properties of the water-repellent material deteriorate with washing. In particular, when a non-fluorine-based water repellent is used as a water repellent, the durability of water-repellent properties to washing is inferior to the case when a fluorine-based water repellent is used. However, in the present invention, the deterioration of water-repellent properties can be compensated by using the specific cross-section fiber, and excellent water-repellent properties can be maintained even after washing.

In order to set the droplet contact angle between the woven or knitted article and a water droplet and the water repellency as described above to an excellent range as in the range of the present invention, it is only necessary to appropriately adjust the weaving density and the knitting density by using the specific cross-section fiber and forming a woven and knitted structure in which fine irregularities are easily generated. As for the weaving density and the knitting density, the droplet contact angle and the water repellency tend to increase by increasing the density of the specific cross-section fiber.

The water-repellent woven or knitted article thus obtained is excellent in abrasion resistance. Thus, grade 4 or more, and grade 4-5 or more in a more preferred embodiment can be achieved as abrasion resistance based on the friction test under wet conditions measured by a method described later. When the abrasion resistance is less than grade 4, there is a possibility that a whitening phenomenon occurs due to scratching during sewing step, wearing, and washing, and the quality is impaired.

The water-repellent woven or knitted article of the present invention is used, so that it is possible to obtain a garment that exhibits water-repellent properties with excellent durability and is also excellent in abrasion resistance. Particularly, the present invention can be very practically used for sportswear which is used in a relatively severe atmosphere, for example, in a snowy mountain or on the ice (e.g., climbs, skis, skates, and the like); outerwear for civil engineering works or the like; and wear frequently exposed to scratching.

EXAMPLES

Hereinafter, the water-repellent woven or knitted article of the present invention will be specifically described with reference to Examples.

The following evaluations were performed for Examples and Comparative Examples.

A. Fineness

The sheath/core conjugate fiber used in the water-repellent woven or knitted article of the present invention is measured for the weight per unit length in an atmosphere at a temperature of 20° C. and a humidity of 65% RH, and the weight corresponding to 10,000 m is calculated from the value. This measurement was repeated 10 times, and the simple average value thereof was rounded off to the closest whole number, and the obtained value was used as the fineness.

B. Droplet Contact Angle

3 μL of water droplets were dropped on the surface of the woven or knitted article using a fully automatic contact angle meter (DM-SA, manufactured by Kyowa Interface Science Co., Ltd.), and the droplet contact angle was measured by a tangent method. It was determined that the larger the value of the droplet contact angle was, the better the water-repellent properties were.

C. Water-Repellent Properties (Spray Method)

A fabric sample subjected to water repellent finishing was cut out to a sample size of 20 cm×20 cm in order to prepare an evaluation sample. On the center of the sample, a circle having a diameter of 11.2 cm was drawn, the sample was stretched so that the area of the circle was increased by 80%, the sample was attached to a test piece holding frame used in a water repellency test (JIS L 1092) (2009), grade determination was performed according to a spray test (JIS L 1092 (2009) "Testing methods for water resistance of textiles"), and the water-repellent properties were evaluated by 5 grades.

D. Durability of Water-Repellent Properties to Washing

As the method of washing the woven or knitted article, the method 103 described in JIS L 0217 (1995) "Textiles-Care labelling code using symbols" was used. The number of times of washing was set to 0 times and 20 times, and the durability of water-repellent properties to washing was evaluated in terms of B and C as described above.

E. Evaluation of Abrasion Resistance of Specific Cross-Section Fiber (Friction Test Under Wet Conditions)

As for the abrasion method, the area of the upper holder bottom was set to about 13 square cm, the number of rubs was set to 90 rpm, the pressing load was set to 7.36 N, the woven or knitted article subjected to the water repellent treatment was fixed on the upper holder and the lower friction plate. The woven or knitted article attached to the upper holder was wetted with distilled water, and then the woven fabric was abraded for 10 minutes using an appearance retention tester described in JIS L 1076 (2012) "Testing methods for pilling of woven fabrics and knitted fabrics". After the abrasion, the degree of discoloration of the woven or knitted article attached to the upper holder was graded in five stages using a discoloration gray scale.

F. Parameter of Cross Section of Specific Cross-Section Fiber

A woven or knitted article using the sheath/core conjugate fiber was subjected to a weight reduction treatment in a sodium hydroxide solution having a concentration of 10 g/L at 100° C. for 60 minutes at a bath ratio of 1:30, thereby obtaining a woven or knitted article containing the specific cross-section fiber in which only the sheath part was eluted. A part of the woven or knitted article was cut perpendicularly to the fiber axis direction so that the transverse sectional shape of the specific cross-section fiber was able to be observed. The specific cross-section fiber was extracted with a scanning electron microscope (SEM), manufactured by Hitachi High-Tech Corporation, and the groove entrance width (w1), the groove wide part width (w2), the groove depth (h), and the diameter of specific cross section fiber (d) were measured using image processing software (Image J). Further, regarding the protrusion of the specific cross-section fiber, the protrusion top width (Pout) and the protrusion bottom width (Pmin) were also measured in a similar manner as described above. The same operation was performed on five specific cross-section fibers, and the average value was used as each fiber's value. Note that these values are calculated to two decimal places in units of μm and rounded off to one decimal place.

G. Weaving Density

The woven fabric subjected to the water repellent treatment was measured for the density in warp and weft directions using a textile densimeter (LUNOMETER, manufactured by Sodeyama Co., Ltd.). The same measurement was performed at five different locations. The simple average value of the densities of the locations was rounded off to the closest whole number, and the obtained value was used as the weaving density.

Example 1

Figure 6:
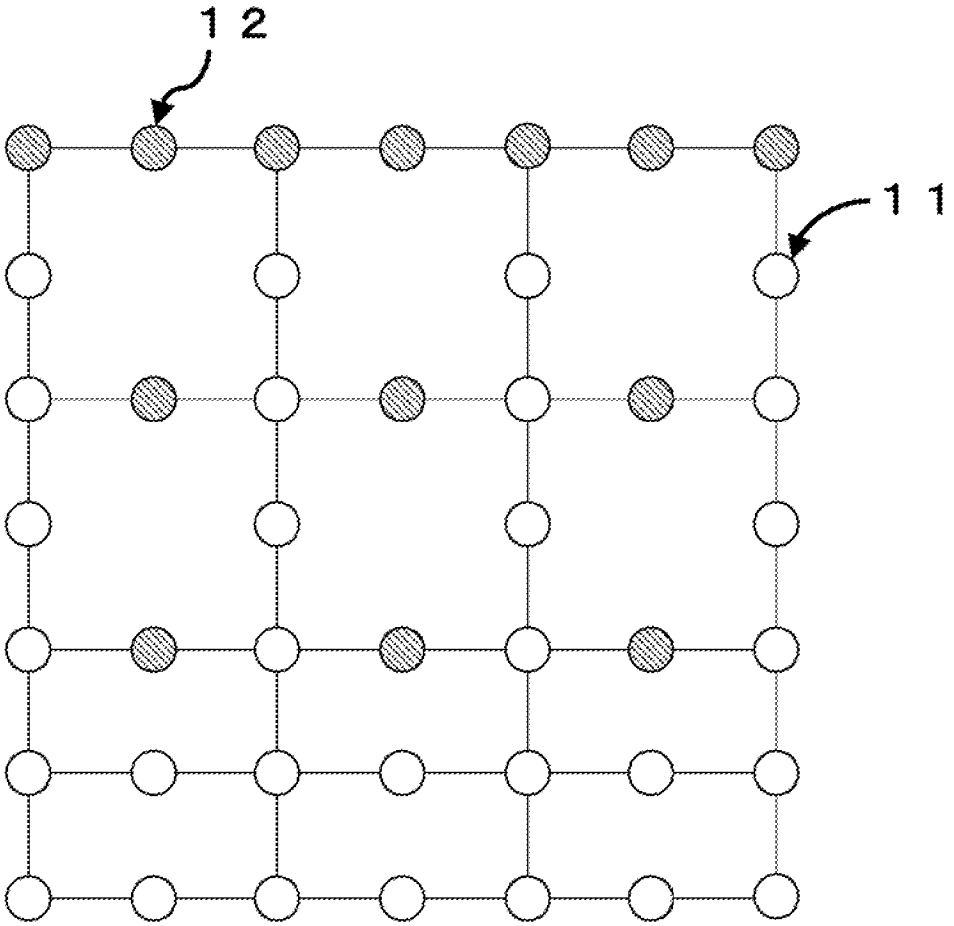
FIG. 6 is a partially enlarged view showing one embodiment of the arrangement of distribution holes in a distribution plate.

A sheath/core conjugate fiber (110 dtex/36 filaments) was obtained by using a spinneret designed such that nylon 6 (N6) was disposed in the core part and polyethylene terephthalate (copolymerized PET1) in which 8.0 mol % of 5-sodium sulfoisophthalic acid and 10 wt % of polyethylene glycol having a molecular weight of 1000 were copolymerized was disposed in the sheath part, separately melting the core part and the sheath part at 270° C., then allowing the core part and the sheath part to flow into the spinneret, and discharging a composite polymer flow from a discharge hole. In the distribution plate immediately above the discharge plate, the portion located at the interface between the core component and the sheath component was set to the arrangement pattern illustrated in FIG. 6, and eight groove portions were formed in one sheath/core conjugate fiber. A distribution hole for sheath component (12 in FIG. 6) is arranged between distribution holes for core component (11 in FIG. 6), whereby the sheath component is disposed so as to be sandwiched between the core components discharged from the distribution holes for core component. This results in formation of a polymer flow complexed to a sheath/core type in which the specific groove shape of the present invention is controlled. Further, the discharge plate used had a discharge introduction hole length of 5 mm, a reduction hole angle of 60°, a discharge hole diameter of 0.3 mm, and a discharge hole length/discharge hole diameter ratio of 1.5. The sheath/core composition ratio was adjusted so as to be 80:20 in terms of a weight ratio.

There was woven a woven fabric having a ⅓ twill weave texture in which multifilaments (56 dtex/40 filaments) having a circular cross-sectional shape and composed of nylon 6 (N6) were arranged as warp yarns, and the sheath/core conjugate fibers were arranged as weft yarns. The warp density is 136 yarns/2.54 cm, and the weft density is 120 yarns/2.54 cm. The obtained woven fabric was scoured with sodium carbonate and a surfactant, and then placed on a pin stenter at 180° C. Then, a weight reduction treatment was performed in a sodium hydroxide solution having a concentration of 10 g/L at a bath ratio of 1:30 at 100° C. for 60 minutes, and only the sheath part was eluted to obtain a fiber having a specific cross-section fiber. Subsequently, the woven fabric was dyed by the following method. The amount of a dye (trade name "Lanasyn Black M-DL p 170" manufactured by Archroma Japan K.K., acid dye) was set to 5% owf, and the treatment was conducted at a bath ratio of 1:30 at 100° C. for 30 minutes. Then, a soaping treatment was performed at 60° C. for 10 minutes using an aqueous surfactant solution having a concentration of 1 g/L. Then, NYLONFIX 501 (manufactured by SENKA corporation) was used at 3% owf, and a fixing treatment was performed under reaction conditions of 80° C.×20 minutes and a bath ratio of 1:30. Further, the fabric was immersed in a treatment liquid prepared by mixing 4 wt % of "NEOSEED" NR-158 (non-fluorine-based water repellent, manufactured by NICCA CHEMICAL CO., LTD.), 0.2 wt % of "BECKAMINE" M-3 (manufactured by DIC Corporation), 0.15 wt % of "CATALYST" ACX (manufactured by DIC Corporation), 1 wt % of isopropyl alcohol, and 94.65 wt % of water, and squeezed with a mangle at a squeezing rate of 60%. The resulting fabric was dried on a pin stenter at 130° C. for 1 minute, and cured with a pin stenter at 170° C. for 1 minute to obtain a water-repellent woven or knitted article of Example 1.

Example 2

The sheath/core conjugate fiber (110 dtex/36 filaments) described in Example 1 was drawn and false-twisted under the conditions of a heater temperature of 170° C. and a magnification of 1.15 times using a friction false-twisting machine to obtain a false-twisted yarn of 96 dtex/36 filaments. This example was performed in a similar manner to Example 1 except that the false-twisted yarn was used as the weft yarn and the weft density was changed to 128 yarns/2.54 cm.

Example 3

This example was performed in a similar manner to Example 1 except that the fineness of the sheath/core conjugate fiber was changed to 56 dtex/36 filaments and the weft density was changed to 168 yarns/2.54 cm.

Comparative Example 1

As the core component and the sheath component, the N6 and copolymerized PET1 used in Example 1 were used, but only the weight reduction treatment was not performed in a textile processing processes, and the warp yarn and the weft yarn were made into multifilaments having a circular cross-sectional shape. Other conditions were performed in a similar manner to Example 1.

Comparative Example 2

The false-twisted yarn used in Example 2 was used as the core component and the sheath component, but only the weight reduction treatment was not performed in a similar manner to Comparative Example 1, and the other conditions were performed in a similar manner to Example 2.

Comparative Example 3

As the core component and the sheath component, the N6 and copolymerized PET1 used in Example 3 were used, but the weight reduction treatment was not performed, and a C6 water repellent having more excellent water-repellent properties than a non-fluorine-based water repellent was used as the water repellent. 3.5 wt % of "AsahiGuard" AG-E082 (manufactured by Meisei Chemical Works, Ltd.) was used as the C6 water repellent, and the other conditions were conducted in a similar manner to Example 3.

In Examples 1 to 3, it was found that since the specific cross-section fiber used for the weft yarn had grooves, the durability of the water-repellent properties was improved even when the non-fluorine-based water repellent was used. Further, even when forced abrasion was applied, the degree of discoloration was good, and abrasion resistance was excellent. Further, as compared to Comparative Example 3 having the same fineness range as that of Example 3, the water-repellent properties after washing in Example 3 are superior to those in the C6 water repellent treated sample in which circular cross-sectional shaped fibers were arranged as warp yarns.

In Comparative Examples 1 and 2, since the fiber used for the weft yarn had a circular cross-sectional shape, the durability of water-repellent properties was poor.

The evaluations of the water-repellent woven or knitted articles of the present invention obtained in Examples 1 to 3 and the water-repellent woven or knitted articles obtained in Comparative Examples 1 to 3 are summarized in Table 1.

TABLE 1

| | | | Example 1 | Example 2 | Example 3 |
|---|---|---|---|---|---|
| Core polymer | | — | N6 | N6 | N6 |
| Sheath polymer | | — | Copolymerized PET1 | Copolymerized PET1 | Copolymerized PET1 |
| Total fineness of sheath/core conjugate fiber before elution | | dtex | 110 | 96 | 56 |
| Specific cross-section fiber (after elution) | Groove entrance width (w1) | μm | 0.9 | 0.9 | 0.6 |
| | Groove wide part width (w2) | μm | 1.7 | 1.6 | 1.0 |
| | w2/w1 | — | 1.9 | 1.8 | 1.7 |
| | Diameter of specific cross section fiber (d) | μm | 18.2 | 17.6 | 10.7 |
| | Groove depth (h) | μm | 3.8 | 3.7 | 2.1 |
| | h/d | — | 0.21 | 0.21 | 0.20 |
| | Protrusion top width (Pout) | μm | 6.6 | 6.4 | 4.0 |
| | Protrusion bottom width (Pmin) | μm | 2.9 | 2.8 | 1.7 |

TABLE 1-continued

| | | | | | | |
|---|---|---|---|---|---|---|
| | Pout/w1 | | — | 7.3 | 7.1 | 6.7 |
| | Pout/Pmin | | — | 2.3 | 2.3 | 2.4 |
| Water repellent formulation | Water repellent | | — | Non-fluorine-based | Non-fluorine-based | Non-fluorine-based |
| Water-repellent properties | Droplet contact angle | Initial stage | ° | 143.8 | 145.2 | 147.0 |
| | | After washing 20 times | ° | 137.1 | 143.7 | 146.4 |
| | Spray method | Initial stage | Grade | 4-5 | 4 | 4 |
| | | After washing 20 times | Grade | 4 | 4 | 4 |
| Abrasion resistance performance | | | Grade | 4-5 | 4-5 | 4 |

| | | | | Comparative Example 1 | Comparative Example 2 | Comparative Example 3 |
|---|---|---|---|---|---|---|
| Core polymer | | | — | N6 | N6 | N6 |
| Sheath polymer | | | — | Copolymerized PET1 | Copolymerized PET1 | Copolymerized PET1 |
| Total fineness of sheath/core conjugate fiber before elution | | | dtex | 110 | 96 | 56 |
| Specific cross-section fiber (after elution) | Groove entrance width (w1) | | μm | — | — | — |
| | Groove wide part width (w2) | | μm | — | — | — |
| | w2/w1 | | — | — | — | — |
| | Diameter of specific cross section fiber (d) | | μm | — | — | — |
| | Groove depth (h) | | μm | — | — | — |
| | h/d | | | | | |
| | Protrusion top width (Pout) | | μm | — | — | — |
| | Protrusion bottom width (Pmin) | | μm | — | — | — |
| | Pout/w1 | | — | — | — | — |
| | Pout/Pmin | | — | — | — | — |
| Water repellent formulation | Water repellent | | — | Non-fluorine-based | Non-fluorine-based | C6 |
| Water-repellent properties | Droplet contact angle | Initial stage | ° | 136.4 | 145.2 | 148.2 |
| | | After washing 20 times | ° | 129.9 | 132.3 | 138.5 |
| | Spray method | Initial stage | Grade | 4-5 | 4 | 4 |
| | | After washing 20 times | Grade | 3-4 | 2-3 | 2-3 |
| Abrasion resistance performance | | | Grade | — | — | — |

DESCRIPTION OF REFERENCE SIGNS

1: Groove
2: Specific cross-section fiber
3: Groove entrance width (w1)
4: Groove wide part width (w2)
5: Groove depth (h)
6: Circumscribed circle of protrusion
7: Inscribed circle of groove
8: Protrusion top width (Pout)
9: Protrusion bottom width (Pmin)
10: Protrusion
11: Distribution hole for core component
12: Distribution hole for sheath component
α: Angle formed by tangent of side of fiber surface of protrusion in protrusion and tangent of side of groove in protrusion

The invention claimed is:

1. A water-repellent woven or knitted article that is a woven or knitted article subjected to a water repellent treatment using a water repellent having a perfluorooctanoic acid concentration of 5 ng/g or less, wherein the woven or knitted article includes, as constituent fibers, fibers having a transverse cross-sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber, a droplet contact angle between the woven or knitted article and water is 135° or more after 20 times of washing in accordance with a method of JIS L 0217 103 and a water repellency is grade 4 or more in accordance with a spray method of JIS L 1092.

2. A water-repellent woven or knitted article that is a woven or knitted article with a water repellent attached, wherein the water repellent contains only a fluorine-based water repellent composed of a fluorine compound having a perfluoroalkyl group having 6 or less carbon atoms or a non-fluorine-based water repellent, and the woven or knitted article includes, as constituent fibers, fibers having a transverse sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber, a droplet contact angle between the woven or knitted article and water is 135° or more after 20 times of washing in accordance with a method of JIS L 0217 103 and a water repellency is grade 4 or more in accordance with a spray method of JIS L 1092.

3. The water-repellent woven or knitted article according to claim 1, wherein a degree of discoloration after a friction test under wet conditions is grade 4 or more.

4. The water-repellent woven or knitted article according to claim 1, wherein the water repellent is a water repellent mainly composed of a silicone-based or paraffin-based compound.

5. A garment comprising at least a part of the water-repellent woven or knitted article according to claim 1.

6. A method for producing the water-repellent woven or knitted article according to claim 1, comprising subjecting a woven or knitted article to a water repellent treatment using a water repellent having a perfluorooctanoic acid concentration of 5 ng/g or less, wherein the woven or knitted article includes, as constituent fibers, fibers having a transverse sectional shape, each fiber has a plurality of grooves at an outer circumference of the transverse cross section, each groove has a wide part, and a size of the grooves in the fibers satisfies the following Formulae (Formula 1) and (Formula 2):

$$w2/w1 \geq 1.3 \quad \text{(Formula 1)}$$

$$0.15 \leq h/d \leq 0.25 \quad \text{(Formula 2)}$$

where w1 represents a groove entrance width, w2 represents a groove wide part width, h represents a groove depth, and d represents a diameter of specific cross section fiber.

7. The method for producing the water-repellent woven or knitted article according to claim 6, wherein a non-fluorine-based water repellent is used as the water repellent.

8. The method for producing the water-repellent woven or knitted article according to claim 6, wherein a water repellent mainly composed of a silicone-based or paraffin-based compound is used as the water repellent.

* * * * *